US006875070B2

(12) United States Patent
Nakajima et al.

(10) Patent No.: US 6,875,070 B2
(45) Date of Patent: Apr. 5, 2005

(54) COOLING SYSTEM FOR A SMALL WATERCRAFT

(75) Inventors: Jun Nakajima, Saitama (JP); Hisashi Matsuo, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/672,934

(22) Filed: Sep. 26, 2003

(65) Prior Publication Data

US 2004/0106338 A1 Jun. 3, 2004

(30) Foreign Application Priority Data

Sep. 27, 2002 (JP) ..... 2002-284218

(51) Int. Cl.[7] ..... B63H 21/10
(52) U.S. Cl. ..... 440/88 N
(58) Field of Search ..... 440/88 C, 88 N

(56) References Cited

U.S. PATENT DOCUMENTS 4,932,348 A * 6/1990 Nix et al. ..... 114/183 R
5,628,285 A * 5/1997 Logan et al. ..... 123/41.14

FOREIGN PATENT DOCUMENTS

JP 2001098942 A 4/2001

* cited by examiner

*Primary Examiner*—Stephen Avila

(74) *Attorney, Agent, or Firm*—Carrier, Blackman & Associates, P.C.; Joseph P. Carrier; William D. Blackman

(57) ABSTRACT

A cooling system is provided for a small watercraft which can prevent corrosion or freezing in a water channel. Water outside the watercraft is fed through a pump 30 and piping P1 or the like to a engine in the watercraft and cools the same, and then is drained from the watercraft. Drain hoses DH1 to 3 are connected to portions of the engine and piping where water tends to remain, and drain ports DH1*a* to 3*a*, which are capable of being opened and closed, are provided at the other ends of the drain hose. A single drain valve DV is provided at the drain port for opening and closing the drain hose.

15 Claims, 8 Drawing Sheets

COOLING SYSTEM FOR A SMALL WATERCRAFT

CROSS-REFERENCE TO RELATED APPLICATIONS

The present application claims priority under 35 U.S.C. 119, based on Japanese patent application No. 2002-284220, filed Sep. 27, 2002.

BACKGROUND OF THE INVENTION

1. Field of the Invention

The present invention relates to a cooling system for a small watercraft. More particularly, the present invention relates to a cooling system in which water from outside the watercraft is fed through a pump and piping, to effectively cool an internal-combustion engine in the watercraft.

2. Description of the Background Art

A personal watercraft is known as a small size craft that is constructed and arranged to glide on the surface of a sea or lake. Jet skis and other types of small personal watercraft are known and are commercially available.

In the boating art, a cooling system for a small watercraft is constructed in such a manner that water outside the watercraft is fed through a jet pump and piping to a engine, which is a heat generating body such as an engine of the line, in the watercraft and cools the same, and then is discharged outside the watercraft. Japanese Patent Document No. JP-A-2001-98942 discloses an example of this type of cooling system.

In some watercraft according to the prior art, there has been a problem in that when the small watercraft is shored and stored, water may remain in portions of the engine or piping, and the portions having water remaining therein may corrode. In winter, the trapped water may freeze, which can cause further damage such as burst pipes or other problems.

SUMMARY OF THE INVENTION

An object of the present invention is to provide a cooling system for a small watercraft, which is capable of draining virtually all the water from the watercraft during storage, and thereby substantially prevents accumulated cooling water from remaining in a water channel.

In order to achieve the object described above, a cooling system for a small watercraft according to a first embodiment hereof is provided for a small watercraft in which water outside the watercraft is fed through a pump and piping to an engine in the watercraft and cools the same, and then is drained from the watercraft. The cooling system according to the first embodiment hereof includes a drain hose connected to portions of the engine and piping where water tends to remain, and a drain port provided at the other end of the drain hose, which includes a valve that can be opened and closed to regulate fluid flow through the drain port.

A cooling system for a small watercraft according to a specific, modified version of the first embodiment is provided for a small watercraft as stated above, and the system is characterized in that a plurality of drain hoses are provided which all feed into said drain port, and a single drain valve is provided at the drain port, for opening and closing same.

The cooling system for a small watercraft according to the first embodiment is constructed in such a manner that water outside the watercraft is fed through a pump and piping to a engine in the watercraft and cools the same, and then is drained from the watercraft, including a drain hose connected to portions of the engine and piping where water tends to remain, and a drain port, provided at the other end of the drain hose, which can be opened and closed to regulate fluid flow through the drain port.

Therefore, according to the cooling system hereof, when the small watercraft is shored and stored, water, which has accumulated in the portions of the engine or piping where water tends to remain, may be drained out of the watercraft by opening the drain port.

Therefore, corrosion or freezing in the water channel may be significantly prevented.

According to the cooling system for a small watercraft in the specific modified embodiment, a plurality of drain hoses are provided, and a single drain valve is provided at the drain port for opening and closing same. Therefore, water in the plurality of portions of the engine or piping where water normally tends to remain may be drained simultaneously by opening the single drain valve.

Therefore, the effort which would otherwise be required, to drain the plurality of portions where water normally tends to remain, may be significantly alleviated.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 3(*b*) is a perspective view of the engine of FIG. 3(*a*).

DETAILED DESCRIPTION

Figure 1:
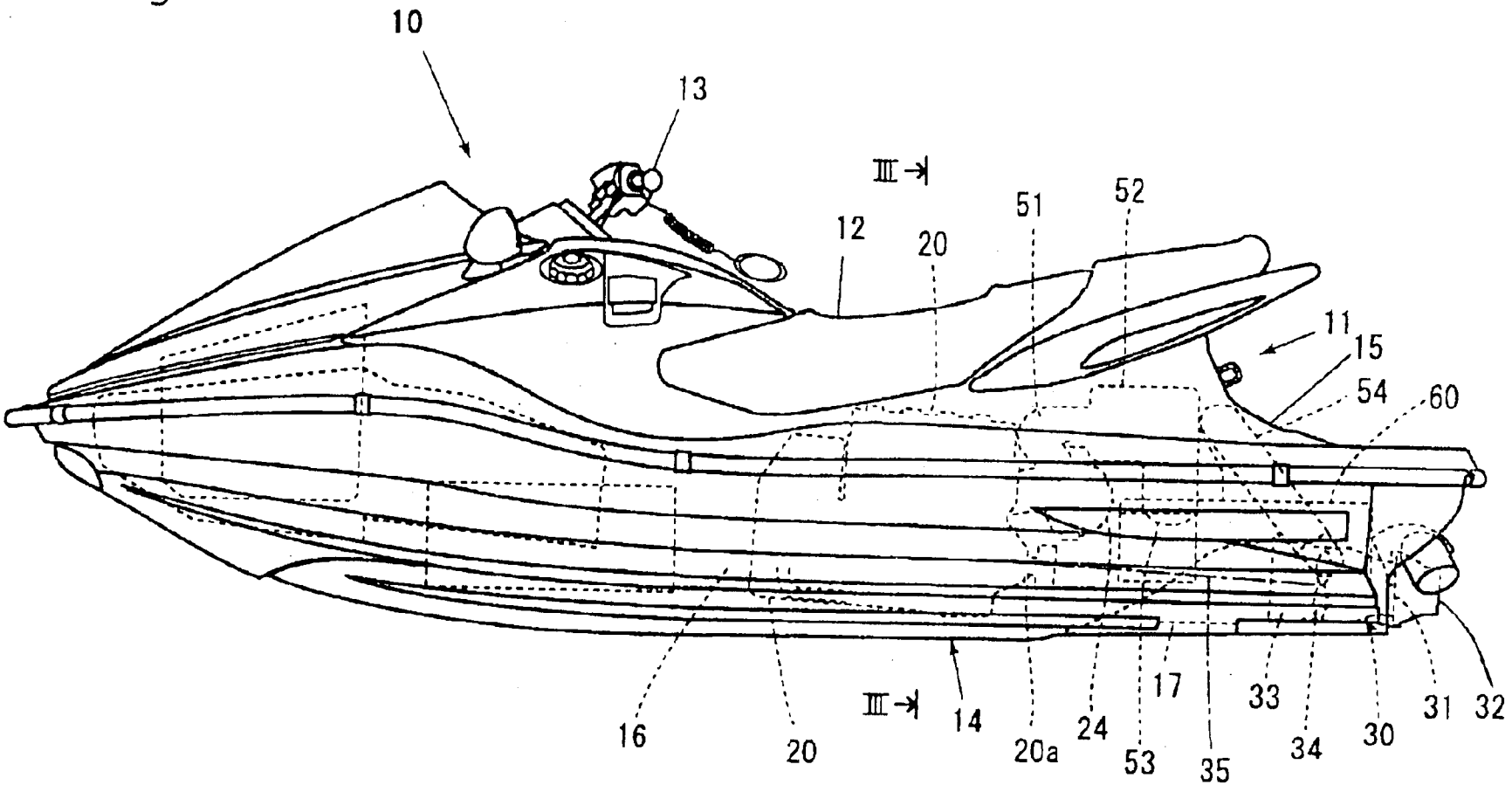
FIG. 1 is a side plan view of a small watercraft employing a cooling system for a small watercraft according to a selected illustrative embodiment of the present invention.

Throughout the following description, expressions of "front", "rear", "left", and "right" denote the directions viewed from the vantage point of a driver.

Referring now to the drawings, a specific illustrative embodiment of the present invention will be described.

As shown in the drawings (mainly in FIG. 1), a small watercraft 10 is a saddle riding type small watercraft in which a boater is able to sit on a seat 12 of a vessel body 11, and in which a boater is able to operate the watercraft 10 while gripping a steering handle 13 with a throttle lever thereon.

The vessel body 11 is a floating structure formed by joining a hull 14 and a deck 15 on top of the deck, with a hollow interior space 16 defined therebetween. In the interior space 16, an engine 20 is mounted on the hull 14, and a jet pump (jet propulsion pump) 30 is mounted in the rear of the hull 14 as propulsion means. The jet pump 30 is driven by the engine 20 via an impeller shaft 35, which extends therebetween.

The jet pump 30 includes a channel 33 extending from a water intake opening 17 formed in the bottom of the bull 14, through a jet flow port 31, opening toward the rear end of the vessel body 11 towards a nozzle 32. An impeller 34 is disposed in the channel 33, and the impeller shaft 35 connects the impeller to a crankshaft 20*a* of the engine 20.

Figure 2:
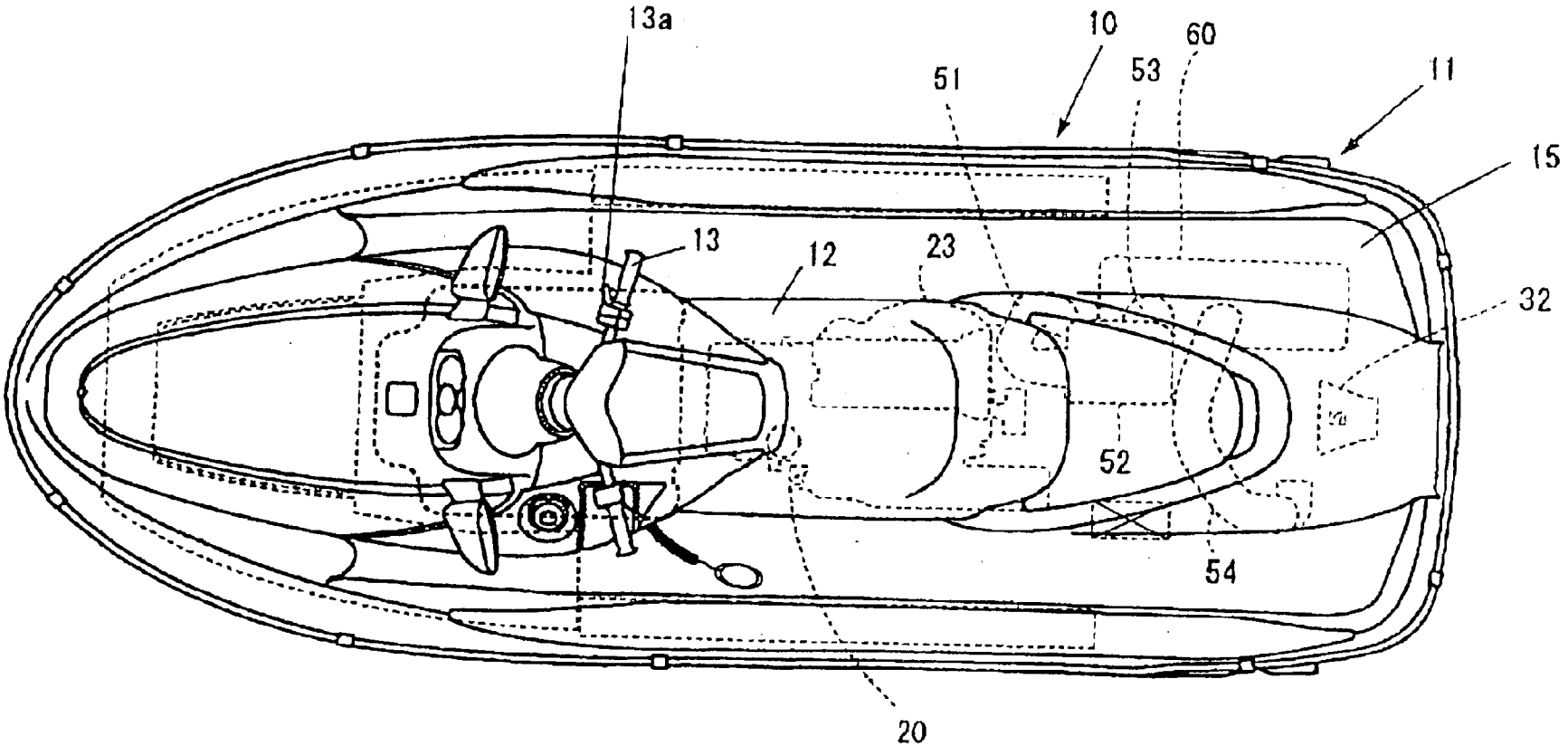
FIG. 2 is a top plan view of the watercraft of FIG. 1.

Therefore, when the impeller 34 is rotated by the engine 20, water taken in through the water intake 17 is ejected outwardly from the jet flow port 31 through the nozzle 32, whereby the vessel body 11 is propelled. The rotation speed of the engine 20, that is, the propelling power generated by the jet pump 30, is controlled by rotating the throttle lever 13*a* (See FIG. 2) of the operating handle 13. The nozzle 32 is linked to the operating handle 13 via an operating wire, not shown, and rotated by turning the handle 13 about its vertical axis, whereby the direction of travel can be changed.

The engine 20 is a four-cylinder, four-cycle in-line DOHC dry-sump engine. As shown in FIG. 1, a crankshaft 20*a* is disposed in the engine 20 so as to extend along the fore-and-aft direction of the vessel body 11.

Figure 3A:
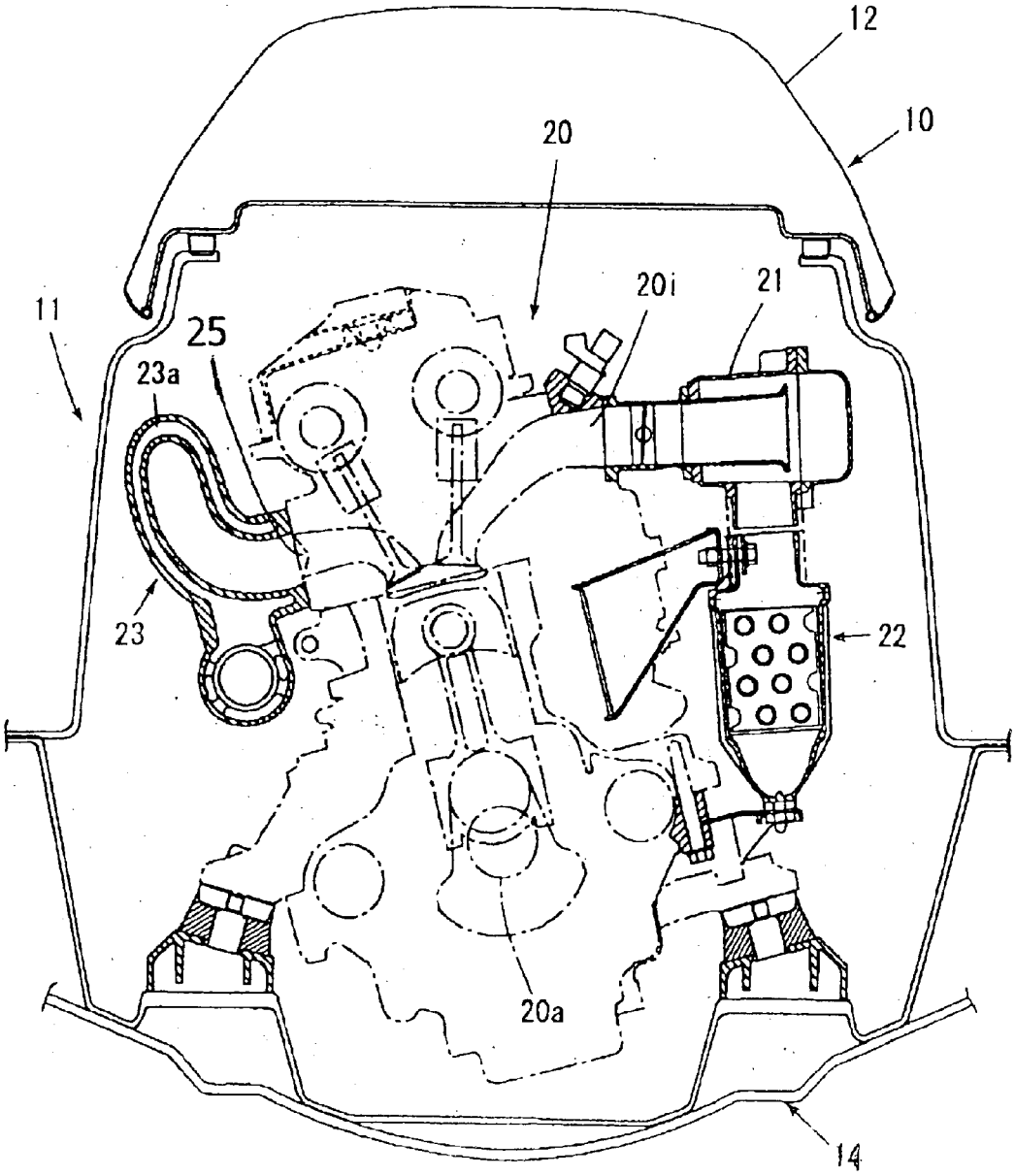
FIG. 3(*a*) is a partly enlarged cross sectional view (partly omitted cross section) of the watercraft of FIG. 1, taken along the line III—III therein, showing mainly an engine 20.
Figure 3B:
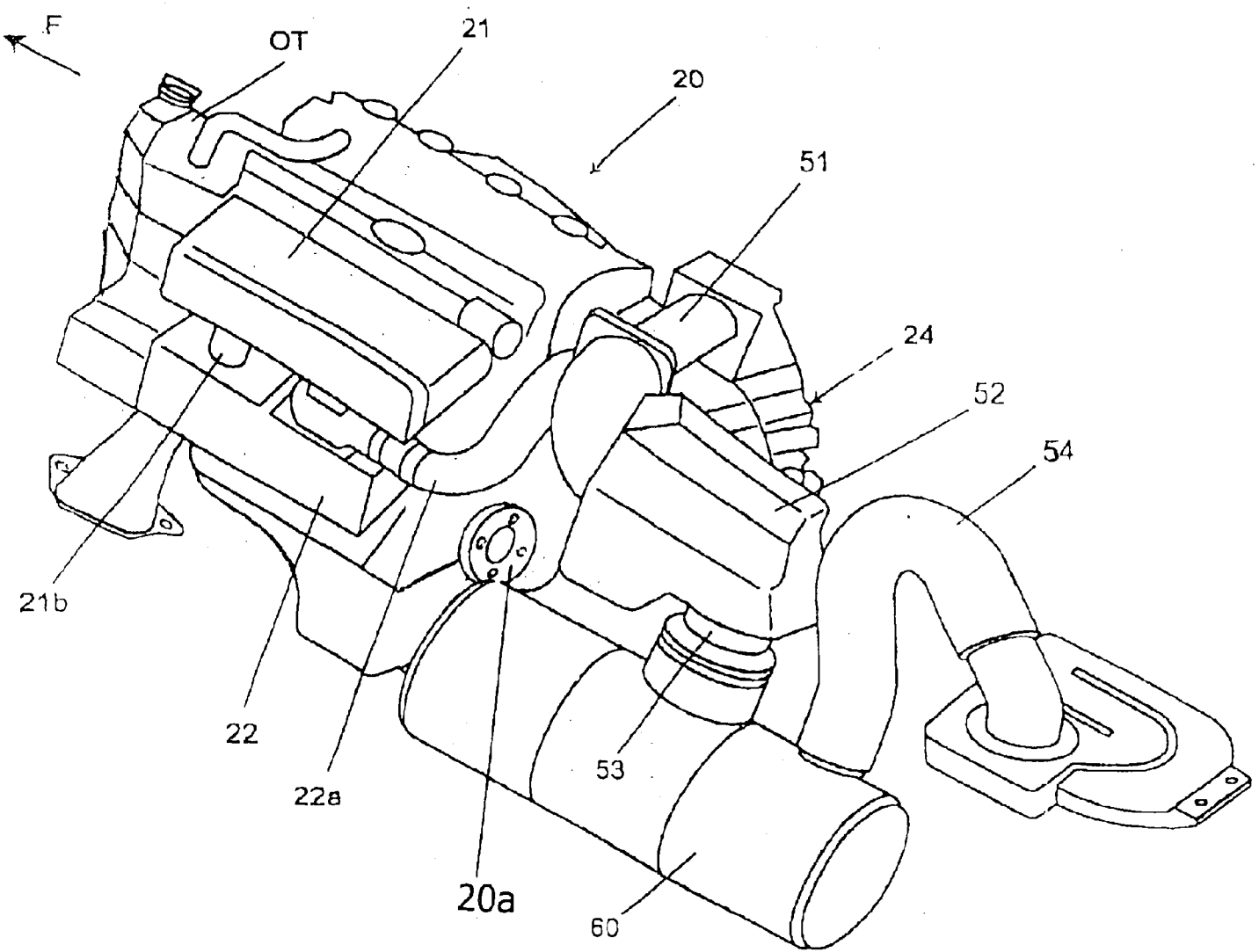

As shown in FIGS. 3(*a*) and (*b*), a surge tank (intake chamber) 21 and an intercooler 22 are connected to the left side of the engine 20. The surge tank 21 is in communication with an intake port 20*i*. The intercooler 22 is connected to the compressor section of a turbocharger 24. An exhaust manifold 23, in communication with an exhaust port 25, is connected to the right side of the engine 20.

As shown in FIG. 3(*b*), a turbocharger (supercharger) 24 is disposed in back of the engine 20, and as noted, the exhaust manifold 23 is connected to a turbine section of the turbocharger 24. An exhaust outlet port of the exhaust manifold 23 (FIG. 3(*b*)) is in fluid communication with an internal turbine drive unit of the turbocharger 24. The intercooler 22 is in fluid communication with a compressor unit of the turbocharger 24 via a feed pipe 22*a*, and the surge tank (intake chamber) 21 is connected to the intercooler 22 via a connector pipe 21*b*.

Exhaust air that has rotated a turbine at the turbine section of the turbocharger 24, passes through a first exhaust pipe 51, a back-flow preventing chamber 52, and a second exhaust pipe 53 into a water muffler 60. The back-flow preventing chamber 52 is provided for preventing water from flowing backward through the exhaust system (entering into the turbocharger 24 and so on) when the watercraft 10 is rolled over. After leaving the water muffler 60, the exhaust air passes through an exhaust/drain pipe 54, and is discharged into a water flow, generated by the jet pump 30.

Figure 4:
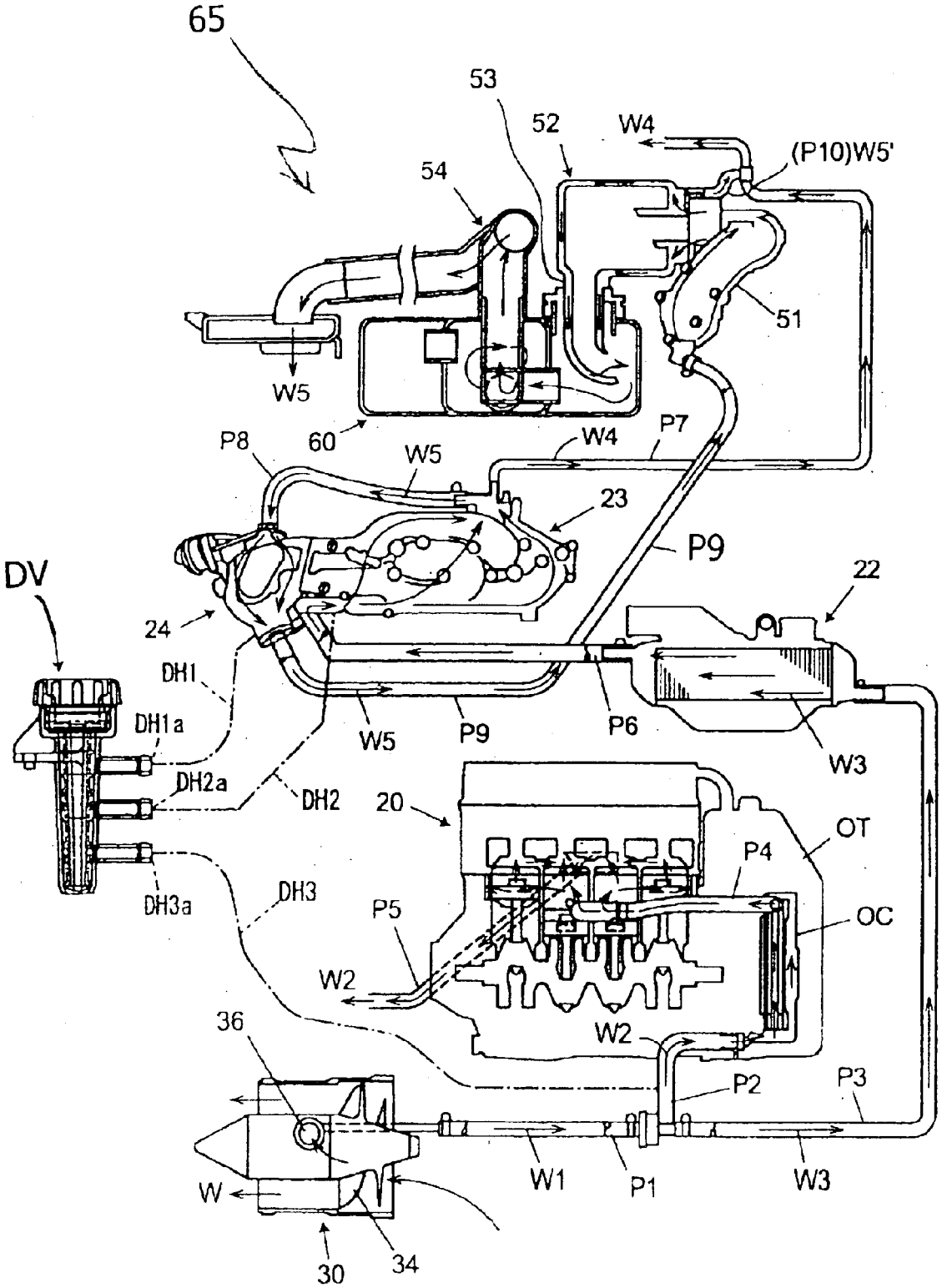
FIG. 4 is a simplified schematic drawing of a cooling system hereof, showing a route of cooling water therethrough.

FIG. 4 is a drawing of a coolant system 65 showing a route of the coolant.

As shown at the bottom of FIG. 4, a coolant intake port 36 is provided on the jet pump 30 downstream from the impeller 34, so that part W1 of jet water flow W generated by the impeller 34 is taken through the coolant intake port 36, and used as coolant water W1. The coolant W1 is supplied to a water jacket of the engine (engine 20, intercooler 22, and so on) through a coolant pipe P1, connected to the intake port 36.

According to the illustrated embodiment, the coolant W1 from the coolant pipe P1, connected to the intake port 36, is branched into two branch pipes P2 and P3.

Coolant W2 in one branch pipe P2 is fed to, and cools an oil cooler OC, stored in an oil tank OT provided on the front portion of the engine 20. After passing through the oil cooler, the coolant W2 is fed to and cools a cylinder block and a cylinder head of the engine 20, via a pipe P4, and then is discharged outside the watercraft, via a pipe P5.

A coolant W3 in the other branch pipe P3 is fed to and cools the intercooler 22, and is then fed through the pipe P6 to cool the exhaust manifold 23.

The coolant W3 which has cooled the exhaust manifold 23 is branched into two sub-branch pipes P7 and P8 above the exhaust manifold 23.

One sub-branch pipe P7 is connected to a pilot water nozzle (not shown) at the extremity thereof, and a coolant W4 flown to the pipe P7 is then discharged from the pilot water nozzle to the ambient environment outside the watercraft.

A coolant W5 flown to the other sub-branch pipe P8 is fed to, and cools the turbocharger 24, and is then fed through the pipe P9 to cool additional exhaust components. The coolant from the pipe P9 flows to the first exhaust pipe 51, the back-flow preventing chamber 52, and the second exhaust pipe 53, and then is injected from the lower end of the second exhaust pipe 53. After the second exhaust pipe 53, the cooling water flows into and cools the water muffler 60, and at the same time, the cooling water is joined with exhaust gas in the water muffler 60, and is subsequently discharged through the exhaust/drain pipe 54 into a water flow (outside the watercraft) generated by the jet pump 30.

Part W5' of the coolant W5, which has cooled the first exhaust pipe 51, is flown through the pipe P10 and joined into the aforementioned pipe P7, and is then discharged from the watercraft through the pilot water nozzle with the coolant W4.

When the small watercraft 10, employing the cooling system as described above, is shored and stored, it is possible that some residual water may remain in part of the engine (engine 20 or the like) or piping P. In addition, when the small watercraft is used on the ocean, it is necessary to feed fresh water into the engine and piping P to wash sea water off. For example, it is necessary to flow running tap water from the pipe P5 backward through the system 65, in order to wash the interior of the engine and piping P. However, when the system 65 has been back-flushed in this way, some of the cleaning water may remain in part of the engine or the piping P.

When remaining water is left standing inside the engine 20 or piping P, portions thereof having water remaining therein may corrode, or in winter, may freeze.

Therefore, in the depicted embodiment, as shown in FIG. 4 by dashed lines, drain hoses DH1, DH2, DH3 are connected to the portions of the engine or piping where water tends to remain. Moreover, drain ports DH1*a*, DH2*a*, DH3*a*, which are capable of being opened and closed, are provided on the ends of the drain hoses DH1, DH2, DH3 that are spaced away from the engine 20.

In this embodiment, the drain hose DH1 is connected to the lower portion of the water jacket of the turbocharger 24. The drain hose DH2 is connected to the lower portion of the water jacket of the exhaust manifold 23, and the drain hose DH3 is connected to the coolant pipe P2 which feeds into the oil cooler OC.

Further in this embodiment, the drain ports DH1*a*, DH2*a*, DH3*a* are provided with a single drain valve DV for opening and closing the drain ports.

Drain Valve Overview

Figure 5:
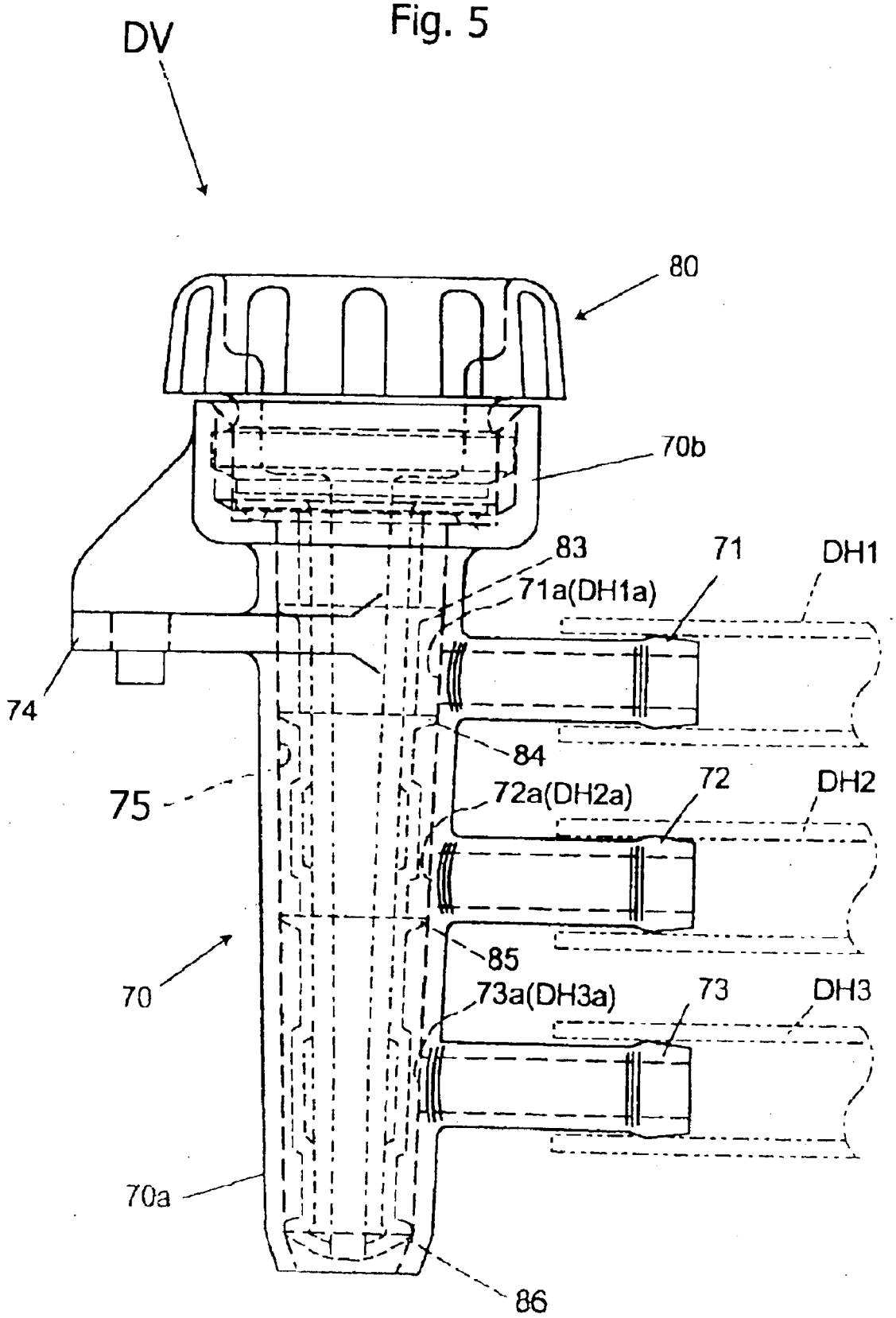
FIG. 5 is an enlarged view of a drain valve DV which is one component of the system hereof, with the internal structure of the drain valve shown in phantom.
Figure 6A:
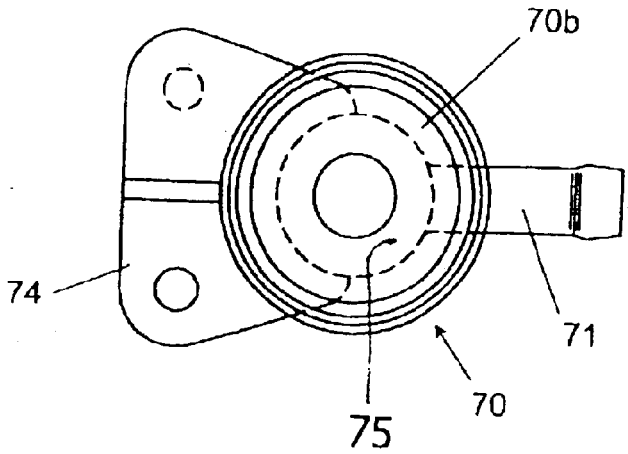
FIG. 6 is a drawing showing a main body of the drain valve DV of FIG. 5, in which (a) is a top plan view, (b) is a front plan view, and (c) is a left side plan view.
Figure 6C:
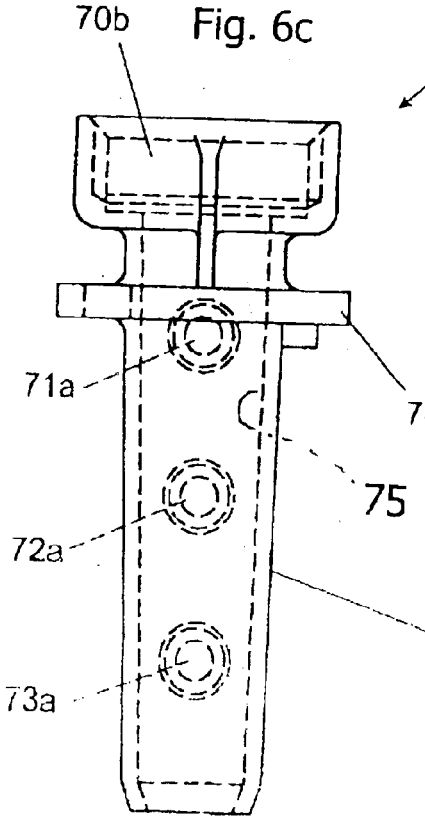
Figure 6B:
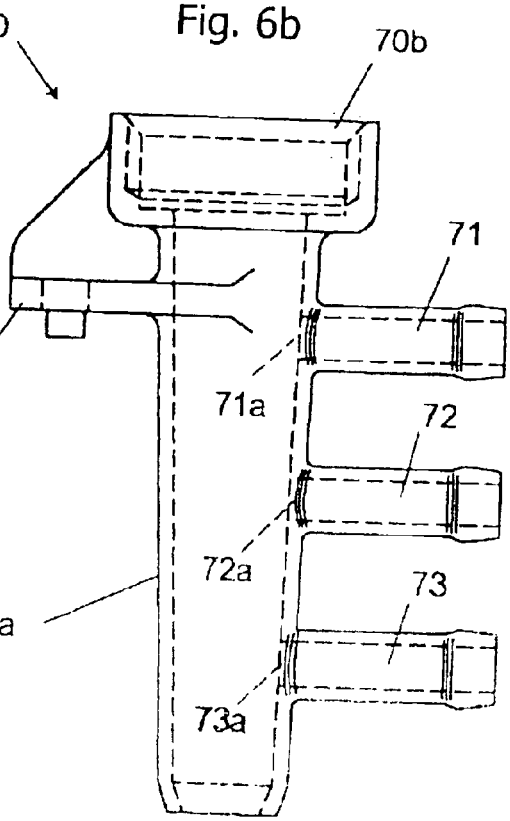
Figure 7A:
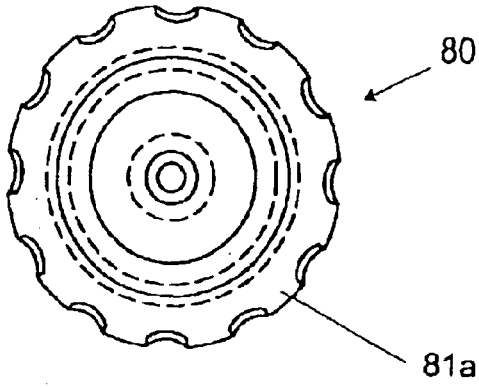
FIG. 7 is a drawing showing a plug which is a component of the drain valve DV of FIG. 5, in which (a) is a top plan view and (b) is a front plan view, partly in section.
Figure 7B:
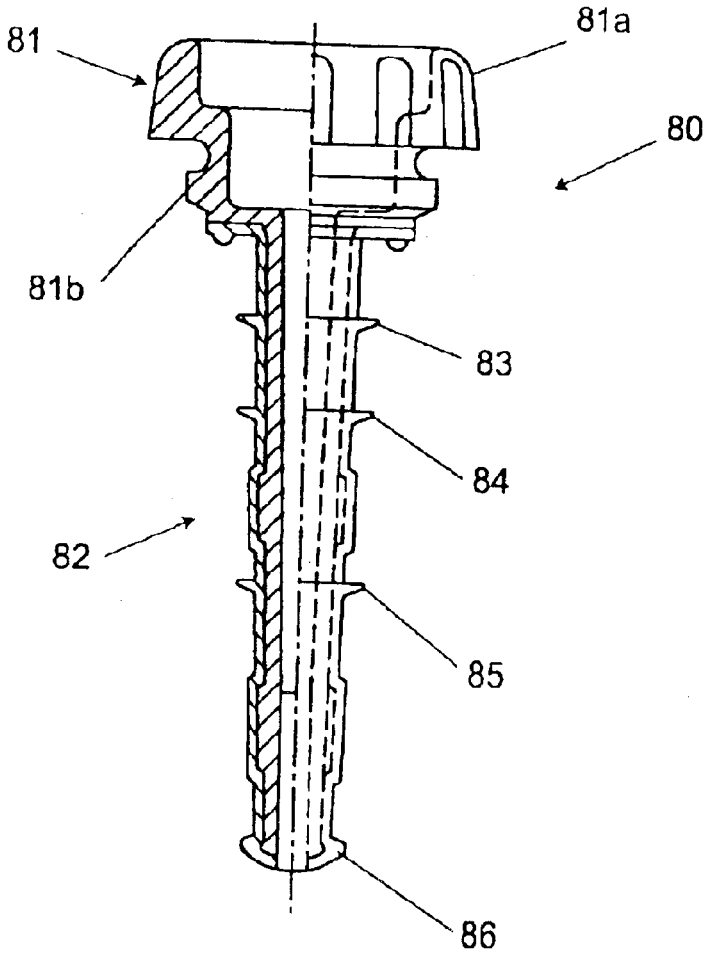

FIG. 5 is an enlarged view of the drain valve DV. FIG. 6 is a drawing showing a main body 70 of the drain valve DV, in which (a) is a plan view, (b) is a front view, and (c) is a left side view. FIG. 7 is a drawing showing a plug 80 for the drain valve DV, in which (a) is a plan view and (b) is a front view partly in section.

As shown in these figures, the drain valve DV is constructed of a main body 70 and a plug 80 to be inserted thereto and removed therefrom. The plug 80 is intended to fit sealably inside, and to stop fluid flow through the main body 70 when fully installed therein.

Main Body

As shown in FIG. 5 and FIG. 6, the main body 70 includes a tapered cylindrical portion 70*a* having a tapered bore 75 formed therein, to receive a plug portion 82 of the plug 80.

The main body 70 also includes three hollow, tubular connecting pipes 71, 72, 73 integrally attached to the cylindrical portion 70*a*, and in fluid communication with the cylindrical bore 75 therein. The cylindrical portion 70*a* and these three connecting pipes 71, 72, 73 are connected to one another at communication ports 71*a*, 72*a*, 73*a*, respectively.

The aforementioned drain hoses DH1, DH2, DH3 are connected to the respective connecting pipes 71, 72, 73, and consequently, the aforementioned communication ports 71*a*, 72*a*, and 73*a* constitute the drain ports DH1*a*, DH2*a*, DH3*a*, which are capable of being alternately opened and closed.

A receiving neck (fitting portion) 70*b*, for the plug 80, is provided on top of the cylindrical portion 70*a*. The main body 70 is provided with a mounting portion 74 for being mounted to a suitable place of the vessel body 11.

Structure of the Plug

As shown in FIG. 5 and FIG. 7, the plug 80 includes a cap portion 81 and a plug portion 82 formed integrally with the cap portion 81 downwardly thereof. The cap portion 81 includes a tab portion 81*a* and a fitting portion 81*b* to be fitted into the fitting portion 70*b* of the aforementioned main body 70. The plug portion 82 includes three ring-shaped sealing lips 83, 84, 85 and a sealing tip 86.

As shown in FIG. 5, when the plug 80 is tightly inserted into the body 70, the fitting portion 81*b* of the cap portion 81 is brought into intimate contact with the fitting portion 70*b* of the main body 70, and the sealing tip 86 of the plug portion 82 is brought into intimate contact with the lower inner surface of the main body 70, so that the entirety of the body 70 is tightly closed.

Therefore, the drain ports DH1*a*, DH2*a*, DH3*a* of the aforementioned drain hoses DH1, DH2, DH3 are also closed, and furthermore, the drain ports DH1*a*, DH2*a*, DH3*a* are each isolated by their respective sealing lips and sealing tips 83, 84, 85, 86, respectively. Consequently, the drain ports DH1*a*, DH2*a*, DH3*a* and the main body 70 are suitably sealed, Therefore, when the plug 80 is fitted to the main body 70, the state of water current in the aforementioned cooling system is suitably maintained.

On the other hand, when the small watercraft is shored and stored, fresh water is fed to the interior of the engine and piping P to wash sea water off when necessary (for example, after being used on the ocean), and then the plug 80 is pulled out from the main body 70.

Accordingly, the aforementioned drain ports DH1*a*, DH2*a*, DH3*a* are opened, and water that tends to remain in part of the engine and piping P is drained out of the aforementioned cooling system through the drain hoses DH1, DH2, DH3 and through the main body 70.

As described thus far, the cooling system for a small watercraft is a cooling system for a small watercraft in which water outside the watercraft is fed through the jet pump 30 and piping P1 and the like to the engine in the watercraft and cools the same, and then is drained from the watercraft, including the drain hose DH1 and so on connected to portions of the engine and piping where water tends to remain, and the drain port DH1*a* and so on, which is capable of being opened and closed, provided at the other end of the drain hose DH1.

Therefore, according to the cooling system for a small watercraft, when the small watercraft 10 is shored and stored, water in the portions of the aforementioned engine or piping where water tends to remain can be drained by opening the aforementioned drain port DH1*a* and so on.

Therefore, corrosion or freezing in the water channel may be substantially prevented.

Since the plurality of drain hoses are provided and the drain ports DH1*a*, DH2*a*, DH3*a* are provided with the single drain valve DV for opening and closing the drain ports DH1*a*, DH2*a*, DH3*a*, water in a plurality of portions of the aforementioned engine or piping where water tends to remain may be drained simultaneously by opening the plurality of drain ports DH1*a*, DH2*a*, DH3*a*.

Therefore, the effort which would otherwise be required, to drain water from the plurality of portions of the engine 20 and piping P where water normally tends to remain, may be significantly alleviated.

Although an embodiment of the present invention has been described thus far, the present invention is not limited to the aforementioned embodiment, and various modifications may be made within the scope of the present invention.

For example, while the drain hose DH1 is connected to the lower portion of the water jacket of the turbocharger 24, the drain hose DH2 is connected to the lower portion of the water jacket of the exhaust manifold 23, and the drain hose DH3 is connected to the coolant pipe P2 into the oil cooler OC in the aforementioned embodiment, the number of the drain hose and the connecting positions may be set as needed.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

Having, thus, described the invention, what is claimed is:

1. A cooling system for a small watercraft in which water outside the watercraft is fed through a pump and piping to at least one cooling workpiece in a watercraft and cools the same, and then is drained from the watercraft, said cooling system comprising:

a drain hose connected to at least one portion of the cooling workpiece or to said piping where water tends to remain, and a drain port, provided at the other end of the drain hose, comprising a valve which can be manually opened and closed to regulate fluid flow therethrough;

wherein the valve comprises a hollow elongated main body and a plug which fits inside of said main body, said plug being manually removable from said main body to allow water to drain outwardly therefrom.

2. A cooling system for a small watercraft according to claim 1, wherein the cooling system comprises a plurality of drain hoses, and a single drain valve for opening and closing the drain port, each of said drain hoses being in fluid communication with said drain valve.

3. The cooling system for a small watercraft according to claim 2, wherein the main body includes a tapered cylindrical portion having a tapered bore formed therein, and a plurality of connecting pipes, each of the connecting pipes being integrally attached to the cylindrical portion and in fluid communication with the tapered bore of the main body.

4. The cooling system for a small watercraft according to claim 3, wherein the drain valve comprises three of said connecting pipes.

5. The cooling system for a small watercraft according to claim 3, wherein the drain valve further comprises a plug having a tapered portion which fits sealingly to the tapered bore of said main body.

6. A cooling system for a small watercraft in which water outside the watercraft is fed through a pump and piping to at least one cooling workpiece in a watercraft and cools the same, and then is drained from the watercraft, said cooling system comprising:

a plurality of drain hoses having proximal ends respectively connected to portions of the cooling workpiece and to said piping in areas where water tends to remain, said drain hoses having distal ends remote from said proximal ends, and a drain port, provided at the distal ends of the drain hoses which can be manually opened and closed to regulate fluid flow therethrough; said drain port comprising a single drain valve for opening and closing the drain port;

wherein the drain valve comprises a hollow elongated main body which includes a tapered cylindrical portion having a tapered bore formed therein, and a plurality of connecting pipes, each of the connecting pipes being integrally attached to the cylindrical portion, and in fluid communication with the tapered bore of the main body.

7. The cooling system for a small watercraft according to claim 6, wherein the drain valve comprises three of said connecting pipes.

8. The cooling system for a small watercraft according to claim 6, wherein the drain valve further comprises a plug having a tapered portion which fits scalingly into the tapered bore of said main body.

9. The cooling system for a email watercraft according to claim 8, wherein said plug comprises a central shaft and a plurality of ring-shaped sealing lips operatively attached to and extending outwardly from said central shaft and a handle attached to an end portion of said central shaft.

10. A cooling system for a small watercraft in which water outside the watercraft is fed through a pump and piping to at least one cooling workpiece in watercraft and cools the same, and then is drained from the watercraft, said cooling system comprising:

a plurality of drain hoses connected to portions of the cooling workpiece and to said piping in areas where water tends to remain, and a drain port, provided at the other ends of the drain hoses, which can be opened and closed to regulate fluid flow therethrough; said drain port comprising a single drain valve for opening and closing the drain port;

wherein the drain valve comprises a main housing which includes a tapered cylindrical portion having tapered bore formed therein, and a plurality of connecting pipes, each of the connecting pipes being integrally attached to the main housing, and in fluid communication with the tapered bore of the main housing, and a single plug comprising a tapered portion which fits sealingly into the tapered bore of the main housing.

11. The cooling system of claim 10, wherein the main housing comprises a single outlet opening positioned at a lower end thereof and coincident with a longitudinal axis of the main housing.

12. The cooling system of claim 10, wherein the connecting pipes are arranged upon the main housing so as to extend in a direction normal to an axial direction of the housing.

13. The cooling system of claim 10, wherein the main housing comprises a single outlet opening positioned at a lower end thereof and coincident with a longitudinal axis of the main housing, wherein the connecting pipes are arranged upon the main housing so as to extend in a direction normal to the longitudinal axis of the housing and wherein the plug is provided with plural circumferentially extending lip positioned so as to be spaced apart in the longitudinal direction.

14. The cooling system of claim 10, wherein the plug comprises a connecting portion, end wherein the main housing comprises a portion which is shaped to operatively engage the connecting portion of the plug such that when the plug is received within the main body the connecting portion maintains the plug in a sealed relationship within the main housing.

15. The cooling system of claim 1, wherein said main body of said valve comprises an elongaged cylindrical portion having a longitudinal axis, and a plurality of substantially parallel connecting pipes extending outwardly from said cylindrical portion, said connecting pipes being oriented substantially normal to the longitudinal axis of said cylindrical portion;

and wherein said plug comprises a central shaft and a plurality of ring-shaped sealing lips operatively attached to and extending outwardly from said central shaft and a handle attached to an end portion of said central shaft.

* * * * *

UNITED STATES PATENT AND TRADEMARK OFFICE

CERTIFICATE OF CORRECTION

PATENT NO. : 6,875,070 B2
DATED : April 5, 2005
INVENTOR(S) : Jun Nakajima and Hisashi Matsuo It is certified that error appears in the above-identified patent and that said Letters Patent is hereby corrected as shown below:

Column 3,
Line 10, change “of the bull” to -- of the hull --.

Column 5,
Line 56, change “sealed,” to -- sealed. --.

Column 7,
Line 17, change “sealingly to the” to -- sealingly into the --.
Line 47, change “which fits scalingly into the” to -- which fits sealingly into the --.
Line 49, change “for a email watercraft” to -- for a small watercraft --.
Line 52, change “central shaft” to -- central shaft; --.

Column 8,
Line 33, change “axis of the housing” to -- axis of the housing, --.
Line 34, change “extending Lip” to -- extending lips --.
Line 37, change “portion, end” to -- portion, and --.
Line 53, change “said central shaft” to -- said central shaft; --.

Signed and Sealed this

Fourth Day of October, 2005

JON W. DUDAS
*Director of the United States Patent and Trademark Office*